US007377583B1

(12) United States Patent
Anthony et al.

(10) Patent No.: US 7,377,583 B1
(45) Date of Patent: May 27, 2008

(54) FOLDING CHAIR

(76) Inventors: John O. Anthony, 2801 Daytona Dr., Killeen, TX (US) 76549-4289; Dianne Anthony, 2801 Daytona Dr., Killeen, TX (US) 76549-4289

( * ) Notice: Subject to any disclaimer, the term of this patent is extended or adjusted under 35 U.S.C. 154(b) by 0 days.

(21) Appl. No.: 11/656,291

(22) Filed: Jan. 22, 2007

(51) Int. Cl.
*A47C 4/08* (2006.01)

(52) U.S. Cl. ..... 297/44

(58) Field of Classification Search ..... 297/42, 297/44, 16.1; 280/250.1, 647
See application file for complete search history.

(56) References Cited

U.S. PATENT DOCUMENTS 1,420,095 A * 6/1922 Gutter ..... 297/44
1,963,835 A * 6/1934 Deland ..... 297/44
D288,871 S 3/1987 Hubert
D296,274 S 6/1988 Winters
4,770,432 A * 9/1988 Wagner ..... 280/250.1
4,917,395 A * 4/1990 Gabriele ..... 280/250.1
5,240,276 A * 8/1993 Coombs ..... 280/647
5,244,222 A * 9/1993 Benoit ..... 280/250.1
6,871,906 B2 3/2005 Haney
6,877,804 B2 4/2005 Chan
6,905,168 B2 6/2005 Noor
7,128,332 B2 * 10/2006 Hermes et al. ..... 280/647
2006/0076806 A1 * 4/2006 Entz ..... 297/42

* cited by examiner

*Primary Examiner*—Peter R. Brown

(57) ABSTRACT

A folding chair has a hinges on the seat and on a back panel and on a brace. The chair further includes side frame elements to which the seat, back panels and brace are all hingeably connected. The chair can be folded into a very compact form.

6 Claims, 2 Drawing Sheets

FOLDING CHAIR

TECHNICAL FIELD OF THE INVENTION

The present invention relates to the general art of chairs, and to the particular field of chairs.

BACKGROUND OF THE INVENTION

Throughout history, people have sought more comfortable seating arrangements. Chairs, stools, and the like allow people to relieve stress on the legs and feet, while remaining alert and performing tasks that do not require a great deal of motion. In the twentieth century, folding chairs have made it possible for people to keep a space clear when necessary, and to erect suitable seating for gatherings or special events. However, current folding chairs possess a number of drawbacks.

Folding chairs of a variety of configurations are known in the art. Indeed, an intended advantage of folding chairs is that, in a folded state, they may be shipped or stored more conveniently than non-folding or fully assembled chairs. Conventional folding chairs generally include a backrest frame having legs that extend at downward angles to become the front legs of the chair, back legs pivotally mounted to the back rest frame, and a seat frame pivoted to the backrest frame, and the back legs. In addition, the prior art is replete with a wide variety of hinge and joint configurations to support and guide the folding members.

While the folding chairs of the prior art fulfill their respective objectives, the folding chair configurations of the prior art often sacrifice stability and durability relative to traditional, non-folding chairs, to achieve their respective functions. Accordingly, a need exists in the art for a folding chair that erects into a stable from approximating traditional, non-folding chairs. Embodiments of the present invention substantially fulfill this need.

The inventor has found that folding chairs are often somewhat heavy. The chair must reliably support the weight of even a fairly large person. The bending stress on any member is proportional to the length of the member multiplied by the force acting upon it. Therefore, the length of the seat effectively multiplies the forces tending to bend or break the seat. Typically, seats for folding chairs have been made from stronger (and heavier) materials, such as steel, to overcome the effect of these bending stresses. The resulting chairs are heavier and therefore cost more to ship, and require more effort to move, fold, and unfold.

Thus, it is desirable to use lightweight materials such as plastics to reduce the weight of folding chairs. However, many known folding chairs, especially those that incorporate lightweight materials, do not stand up to repetitive use. Groups such as the business and institutional furniture manufacturers' association have set up standards for portable furniture. Such standards typically require that portable chairs be designed to receive a given weight loading to simulate use for a specified number of cycles, often on the order of 100,000. Many known folding chairs bend or break after only a few thousand cycles, and therefore can be expected to have a relatively short useful life.

Still further, many known folding chairs are somewhat expensive to produce because the manner in which they are assembled requires the use of a great deal of manual labor. The legs must often be properly aligned with the seat so that mechanical fasteners can be attached to the legs and the seat. If metal supporting parts are to be threaded through the lightweight seat member to connect the legs, the lightweight seat member may have to be aligned with each leg assembly so that the threading operation can be carried out. Often, the various fasteners involved must be installed at locations that are not easily accessible for machinery. Thus, the fasteners must often be installed by hand.

Accordingly, a need exists for a portable, folding chair that is lightweight and comfortable, and yet folds to a thin, stackable configuration. Such a chair must safely support the weight of a fairly heavy person. In addition, the chair should be inexpensive to produce in large quantities with a minimum of parts and assembly.

SUMMARY OF THE INVENTION

The above-discussed disadvantages of the prior art are overcome by a folding chair that has a hinges on the seat and on a back panel and on a brace. The chair further includes side frame elements to which the seat, back panels and brace are all hingeably connected. The chair can be folded into a very compact form.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
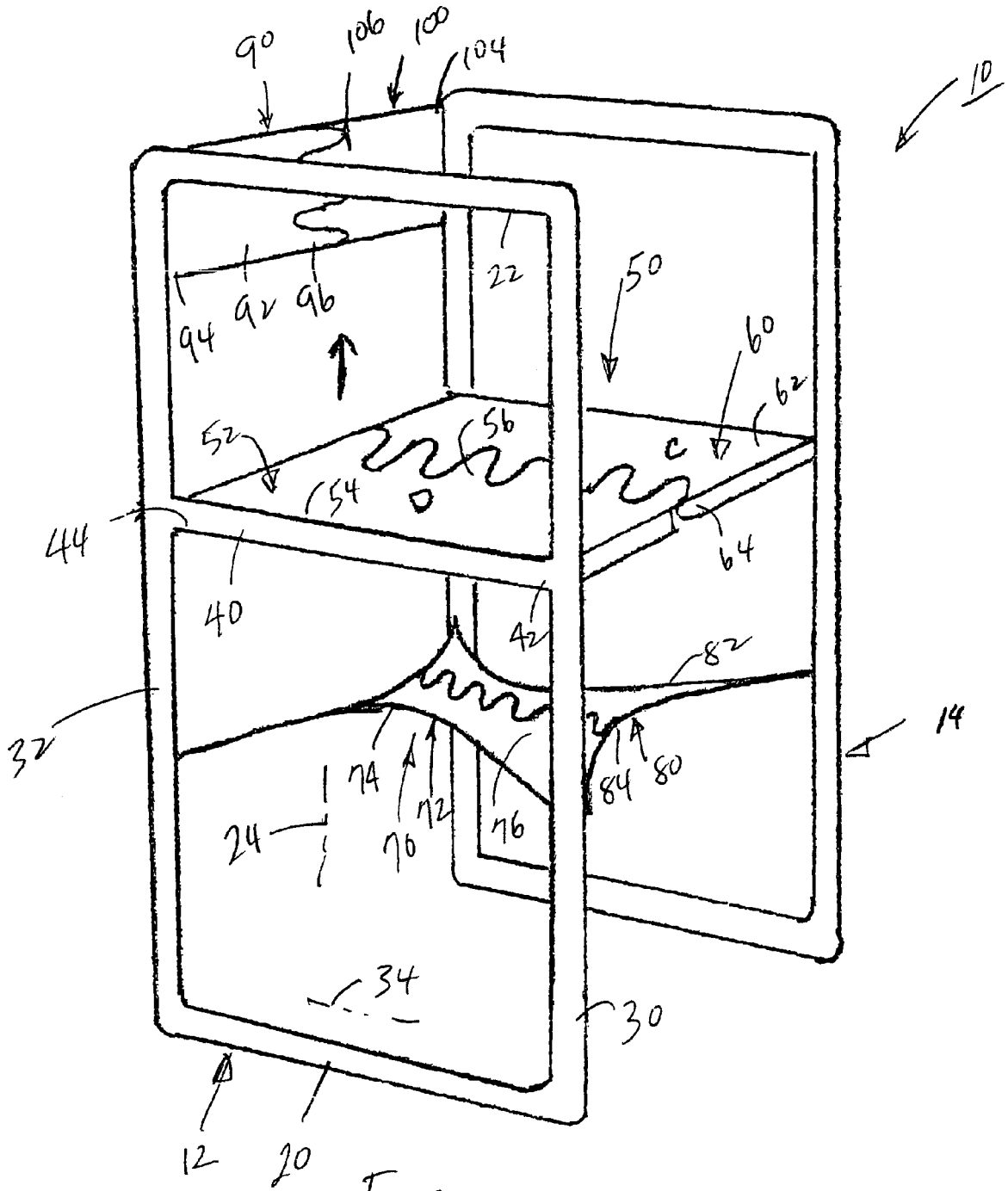
FIG. 1 is a perspective view of a folding chair embodying the present invention.
Figure 2:
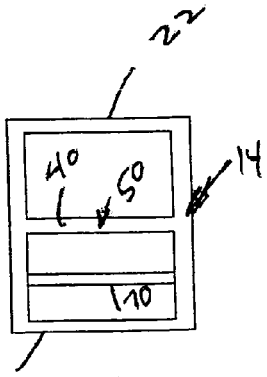
FIG. 2 is a right side elevational view thereof.
Figure 3:
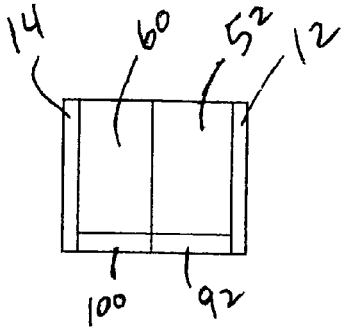
FIG. 3 is a top view thereof.
Figure 4:
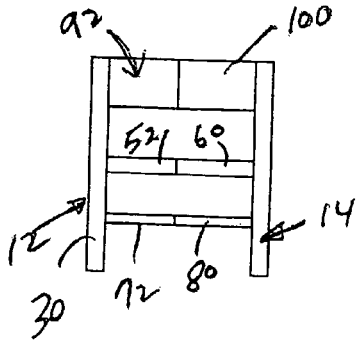
FIG. 4 is a front side view thereof.
Figure 5:
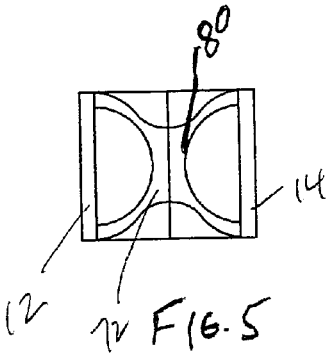
FIG. 5 is a bottom view thereof.
Figure 6:
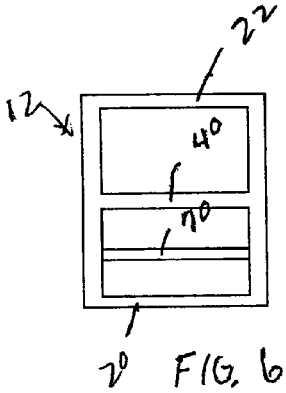
FIG. 6 is a left side view thereof.
Figure 7:
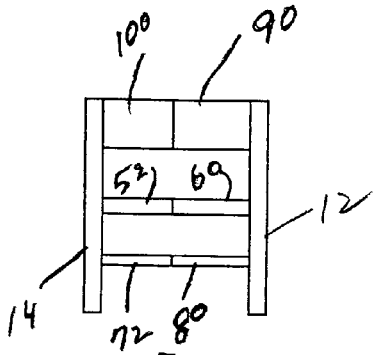
FIG. 7 is a back view thereof.

Referring to the figures, it can be understood that the present invention is embodied in a folding chair 10 which overcomes the drawbacks associated with the prior art. Chair 10 comprises a first left rectangular side frame 12 and a second right rectangular side frame 14. The side frames are identical to each other. Therefore, only one side frame will be described, it being understood that the following description applies to both side frames. Each side frame includes a first end 20 which is a bottom end when the side frame is set up, with the set up condition being shown in FIG. 1. Each side frame further includes a second end 22 which is a top end when the side frame is set up and a longitudinal axis 24 which extends between first end 20 and second end 22 of the side frame. Each side frame further includes a first side 30 which is a front side when the side frame is set up, a second side 32 which is a rear side when the side frame is set up and a width axis 34 which extends between first side 30 and second side 32 of the side frame. A cross bar 40 is attached at end 42 thereof to first side 30 and at end 44 thereof to second side 32 and which extends in the direction of width axis 34 of the side frame. Each side frame is planar and each side frame is contained in a plane.

A seat section 50 includes a first portion 52 which has a first end 54 hingeably attached to the cross bar on the first side frame to move between a use orientation extending perpendicular to the plane containing the first side frame toward the second side frame and a stored orientation lying in the plane containing the first side frame. First portion 52 further includes a second end 56 which is sinuous in shape. Seat section 50 further includes a second portion 60 which has a first end 62 hingeably attached to the cross bar on the second side frame to move between a use orientation extending perpendicular to the plane containing the second side frame toward the first side frame and a stored orientation lying in the plane containing the second side frame. Second portion 60 further includes a second end 64 which is sinuous in shape. The second end of the second portion being shaped to snugly and neatly mate with the second end of the first portion when both portions are in the use orientation so the seat section is planar as can be understood from the teaching of FIG. 1.

The chair further comprises a brace portion 70 which includes a first portion 72 which has a first end 74 hingeably attached to first side 30 of the first side frame and to second side 32 of the first side frame to move between a use orientation extending perpendicular to the plane containing the first side frame toward the second side frame and a stored orientation lying in the plane containing the first side frame. Brace portion 70 further includes a second end 76 which is sinuous in shape. Brace portion 70 further includes a second portion 80 which has a first end 82 hingeably attached to the first side of the second side frame and to the second side of the second side frame to move between a use orientation extending perpendicular to the plane containing the second side frame toward the first side frame and a stored orientation lying in the plane containing the second side frame. Second portion 80 further includes a second end 84 which is sinuous in shape. Second end 84 of second portion 80 of the brace portion is shaped to snugly and neatly mate with second end 76 of first portion 70 of the brace portion when both portions of the brace portion are in the use orientation so the brace portion is planar.

Chair 10 further comprises a back panel 90 which includes a first portion 92 which has a first end 94 hingeably attached to the second side of the first side frame to move between a use orientation extending perpendicular to the plane containing the first side frame toward the second side frame and perpendicular to the plane containing the seat portion and a stored orientation lying in the plane containing the first side frame. First portion 92 further includes a second end 96 which is sinuous in shape. Back panel 90 further includes a second portion 100 which has a first end 104 hingeably attached to the second side of the second side frame to move between a use orientation extending perpendicular to the plane containing the second side frame toward the first side frame and perpendicular to the plane containing the seat portion and a stored orientation lying in the plane containing the second side frame. Second portion 100 further includes a second end 106 which is sinuous in shape. Second end 106 of the second portion of the back panel is shaped to snugly and neatly mate with second end 96 of first portion 90 of the back panel when both portions of the back panel are in the use orientation so the back panel is planar.

Figure 8A:
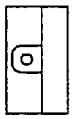
FIG. 8A is a side view of a hinge.
Figure 8:
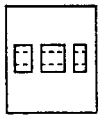
FIG. 8 is a top view of a hinge.
Figure 9A:
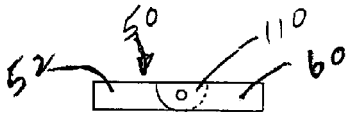
FIG. 9A is a side view of the hinge shown in FIG. 9.
Figure 10:
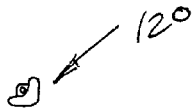
FIG. 10 is a side view of another hinge.
Figure 9:
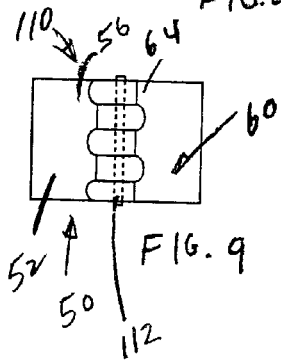
FIG. 9 is a top view of another hinge.

In one form of the chair, the seat section includes a hinge 110 (FIGS. 9 and 9A) connecting the second ends of the portions of the seat section together. The hinge includes a hinge pin 112. Yet another form of the chair includes a similar hinge on the back panel and a similar hinge on the brace portion. The chair can be formed of plastic so it is light weight yet strong and durable. Hinges, such as hinge 120 shown in FIG. 10 can be used to attach the parts to the side frames. Yet another form of the hinge that can be used on the chair is shown as hinge 130 in FIGS. 8 and 8A. The hinges can include steel inserts for added strength.

Another form of the seat can have the portions 52 and 60 concave. The back panel can also include concave portions. The corners of the seat and back panel can be rounded if desired. A second brace portion can be included near the bottom ends of the side frames for further support if desired. The chair can be folded outwards toward the side frames with the back panel folding towards the rear. The seat folds up as does the brace section.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A folding chair comprising:

A) a first rectangular side frame and a second rectangular side frame, each side frame including (1) a first end which is a bottom end when the side frame is set up, (2) a second end which is a top end when the side frame is set up, (3) a longitudinal axis which extends between the first end and the second end of the side frame, (4) a first side which is a front side when the side frame is set up, (5) a second side which is a rear side when the side frame is set up, (6) a width axis which extends between the first side and the second side of the side frame, (7) a cross bar which is attached to the first side and to the second side and which extends in the direction of the width axis of the side frame, and (8) each side frame being planar and each side frame being contained in a plane;

B) a seat section which includes (1) a first portion having a first end hingeably attached to the cross bar on the first side frame to move between a use orientation extending perpendicular to the plane containing the first side frame toward the second side frame and a stored orientation lying in the plane containing the first side frame, and a second end which is sinuous in shape, and (2) a second portion having a first end hingeably attached to the cross bar on the second side frame to move between a use orientation extending perpendicular to the plane containing the second side frame toward the first side frame and a stored orientation lying in the plane containing the second side frame, and a second end which is sinuous in shape, the second end of the second portion being shaped to snugly and neatly mate with the second end of the first portion when both portions are in the use orientation so the seat section is planar;

C) a brace portion which includes (1) a first portion having a first end hingeably attached to the first side of the first side frame and to the second side of the first side frame to move between a use orientation extending perpendicular to the plane containing the first side frame toward the second side frame and a stored orientation lying in the plane containing the first side frame, and a second end which is sinuous in shape, and (2) a second portion having a first end hingeably attached to the first side of the second side frame and to the second side of the second side frame to move between a use orientation extending perpendicular to the plane containing the second side frame toward the first side frame and a stored orientation lying in the plane containing the second side frame, and a second end which is sinuous in shape, the second end of the second portion of the brace portion being shaped to snugly and neatly mate with the second end of the first portion of the brace portion when both portions of the brace portion are in the use orientation so the brace portion is planar; and D) a back panel which includes (1) a first portion having a first end hingeably attached to the second side of the first side frame to move between a use orientation extending perpendicular to the plane containing the first side frame toward the second side frame and perpendicular to the plane containing the seat portion and a stored orientation lying in the plane containing the first side frame, and a second end which is sinuous in shape, and (2) a second portion having a first end hingeably attached to the second side of the second side frame to move between a use orientation extending perpendicular to the plane containing the second side frame toward the first side frame and perpendicular to the plane containing the seat portion and a stored orientation lying in the plane containing the second side frame, and a second end which is sinuous in shape, the second end of the second portion of the back panel being shaped to snugly and neatly mate with the second end of the first portion of the back panel when both portions of the back panel are in the use orientation so the back panel is planar.

2. The folding chair defined in claim 1 further including a hinge on the seat section hingeably connecting the first portion of the seat section to the second portion of the seat section.

3. The folding chair defined in claim 2 further including a hinge on the brace portion hingeably connecting the first portion of the brace portion to the second portion of the brace portion.

4. The folding chair defined in claim 3 further including a hinge on the back panel hingeably connecting the first portion of the back panel to the second portion of the back panel.

5. The folding chair defined in claim 2 wherein the hinge on the seat section hingeably connecting the first portion of the seat section to the second portion of the seat section includes a hinge pin.

6. The folding chair defined in claim 1 wherein the side frames and the seat section and the brace portion and the back panel are all formed of plastic.

* * * * *